US009611860B2

(12) United States Patent
Son et al.

(10) Patent No.: US 9,611,860 B2
(45) Date of Patent: Apr. 4, 2017

(54) CENTRIFUGAL FAN AND AIR CONDITIONER USING THE SAME

(71) Applicant: LG ELECTRONICS INC., Seoul (KR)

(72) Inventors: Sangyuk Son, Seoul (KR); Junghoon Kim, Seoul (KR); Minu Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 568 days.

(21) Appl. No.: 13/998,514

(22) Filed: Nov. 7, 2013

(65) Prior Publication Data

US 2014/0133988 A1 May 15, 2014

(30) Foreign Application Priority Data

Nov. 13, 2012 (KR) ..... 10-2012-0127824

(51) Int. Cl.
*F04D 29/30* (2006.01)
*F04D 29/28* (2006.01)

(52) U.S. Cl.
CPC ..... *F04D 29/281* (2013.01); *F04D 29/282* (2013.01); *F04D 29/30* (2013.01)

(58) Field of Classification Search
CPC ..... F04D 17/10; F04D 29/002; F04D 29/242; F04D 29/245; F04D 29/281; F04D 29/30; F05D 2240/307; F05D 2260/96
See application file for complete search history.

(56) References Cited

U.S. PATENT DOCUMENTS 2,633,390 A * 3/1953 Bush ..... A01D 87/10 406/97
3,006,534 A * 10/1961 McDonald ..... F04D 29/282 416/186 A
3,221,662 A * 12/1965 White ..... F04D 29/2261 415/1
5,466,120 A 11/1995 Takeuchi et al.
6,619,914 B2 * 9/2003 Yokoyama ..... F04D 29/30 415/121.2
8,616,504 B2 * 12/2013 Brewer ..... B64C 3/58 244/212
8,764,403 B2 * 7/2014 Greenblatt ..... F04D 29/384 416/223 A (Continued)

FOREIGN PATENT DOCUMENTS

CN 1321837 A 11/2001
CN 2599291 Y 1/2004

(Continued)

OTHER PUBLICATIONS

Chinese Office Action with English Translation issued in Application 201310571394.1 dated Sep. 1, 2015.

*Primary Examiner* — Ninh H Nguyen
(74) *Attorney, Agent, or Firm* — KED & Associates, LLP

(57) ABSTRACT

A centrifugal fan and an air conditioner using the same are provided. A gurney flap having a rectangular plate or a S-shaped, twisted gurney flap may be formed in a tip of a blade provided in or on a hub of the centrifugal fan, so that noise may be effectively reduced, and efficiency increased. Further, the blade with the gurney flap may be easily formed integrally with the hub, enhancing productivity.

12 Claims, 11 Drawing Sheets

(56) References Cited

U.S. PATENT DOCUMENTS

| | | | | |
|---|---|---|---|---|
| 2002/0106277 | A1* | 8/2002 | Chapman | F04D 29/023 415/206 |
| 2007/0116576 | A1* | 5/2007 | Chang | F04D 29/281 416/228 |
| 2011/0123348 | A1* | 5/2011 | Greenblatt | B64C 11/18 416/241 R |

FOREIGN PATENT DOCUMENTS

| | | | |
|---|---|---|---|
| CN | 201318295 | Y | 9/2009 |
| JP | H08-261197 | A | 10/1996 |
| JP | 2004-204773 | A | 7/2004 |
| KR | 10-2005-0119071 | | 12/2005 |

* cited by examiner

CENTRIFUGAL FAN AND AIR CONDITIONER USING THE SAME

CROSS-REFERENCE TO RELATED APPLICATION(S)

This application claims priority under 35 U.S.C. §119 to Korean Application No. 10-2012-0127824 filed on Nov. 13, 2012, whose entire disclosure is hereby incorporated by reference.

BACKGROUND

1. Field

A centrifugal fan and an air conditioner using the same are disclosed herein.

2. Background

FIG. 1 shows a centrifugal fan used in a general air conditioner. The centrifugal fan 10, used in, for example, an indoor unit or device of an air conditioner, may include a hub 11, a plurality of blades 12, and a shroud 13.

As shown in FIG. 1, as the hub 11 having the plurality of blades 12 is rotated at a high speed in a counterclockwise (P) direction by a rotational force of a motor, a fluid that has been sucked through a central hole provided in or at an upper side of the shroud 13 is discharged to a side surface N by the plurality of blades 12 formed in the hub 11. However, a wing tip vortex S is generated at an upper side of the blade 12, as shown in FIGS. 2A-2B, thus causing noise and aerodynamic loss. An air flow W, which is opposite perpendicular to a direction of discharge is exerted to a right side of the blade 12, so that noise is unnecessarily increased and efficiency of the fan deteriorated.

Centrifugal fans having a novel structure have been suggested to address such issues. As shown in FIG. 3, centrifugal fan 20 disclosed in Korean Patent Application Publication No. 2005-0119071 has a structure in which a plurality of blades 22 are formed in or on a hub 21 without a shroud.

A side of each of the plurality of blades 22 is formed by injection molding to have a stereoscopic shape 22*a* of a twist similar to an S shape, as shown in FIGS. 4A-4B, and thus, an upper side and a bottom side of each of the plurality of blades 22 has a step having a predetermined distance D with respect to a vertical direction.

The upper side of the blade 22, as shown in FIGS. 4A-4B, has a gentle wing tip 22*b* with an area increasing towards its outer circumferential portion from its inner portion with respect to a middle portion of the hub 21. Accordingly, the gentle wing tip 22*b* may pull a generated wing tip vortex S thereby keeping the wing tip vortex S constant. The gentle wing tip 22*b* may also send the fluid in an opposite direction of the hub 21 to thereby accelerate the flow of the fluid. The detailed description is disclosed in Korean Patent Application Publication No. 2005-0119071.

However, in order to inject-mold the plurality of blades 22 provided on the hub 21 so that the plurality of blades 22 have a twisted stereoscopic shape 22*a* similar to the S shape, a highly sophisticated injection molding technology is required, thus increasing fabrication costs. Moreover, in a case that the stereoscopic blades 22 with the above-described gentle wing tips 22*b* formed at upper sides thereof are individually injection-molded and formed on the hub 21, working efficiency may be extremely deteriorated in light of productivity.

BRIEF DESCRIPTION OF THE DRAWINGS

Embodiments will be described in detail with reference to the following drawings in which like reference numerals refer to like elements, and wherein.

DETAILED DESCRIPTION

Figure 1:
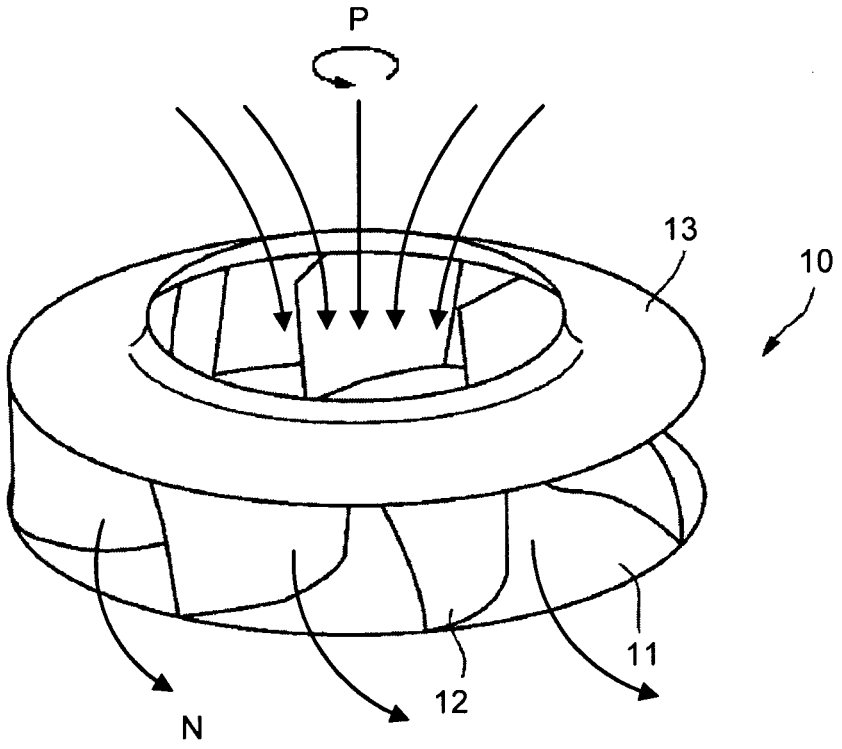
FIG. 1 illustrates a general centrifugal fan.
Figure 2A:
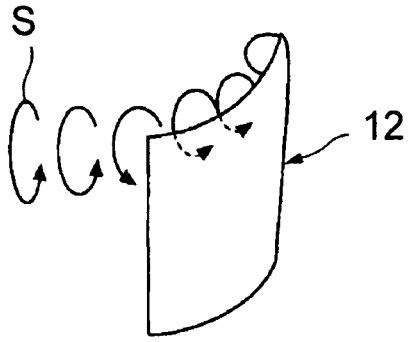
FIGS. 2A-2B illustrate an air flow and a wing tip vortex generated at blades of the general centrifugal fan of FIG. 1.
Figure 2B:
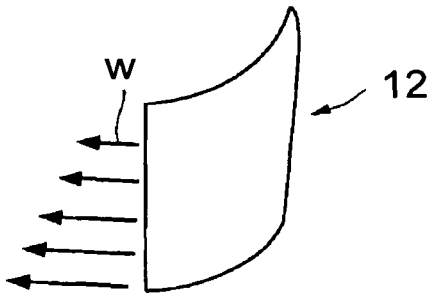

Embodiments of a centrifugal fan and an air conditioner using the centrifugal fan will be hereinafter described in detail with reference to the accompanying drawings. Where possible, like reference numerals have been used to indicate like elements, and repetitive disclosure has been omitted.

The centrifugal fan according to embodiments may be used in various types of air conditioners in which the creation of less noise during quick rotation is desired, such as indoors.

The centrifugal fan according to embodiments may include a hub that is rotated at a high speed by a rotational force of a motor. Multiple blades may be formed in or on the hub, and each blade may have a gurney flap on its tip, allowing for noise reduction, increasing fan efficiency, and making it easy to injection mold.

Figure 5:
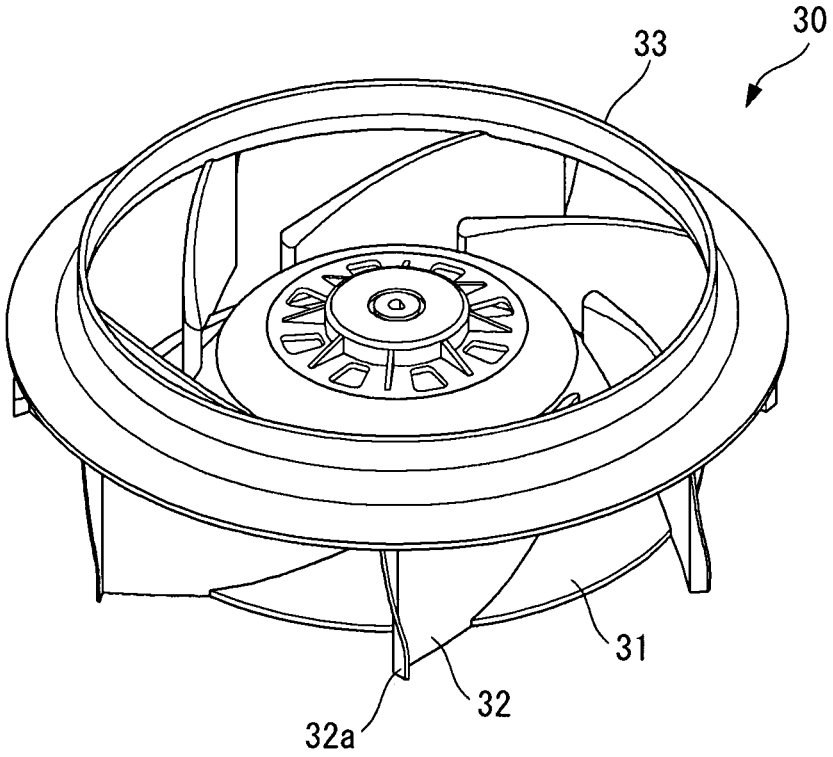
FIG. 5 is a perspective view of a centrifugal fan according to an embodiment.
Figure 6:
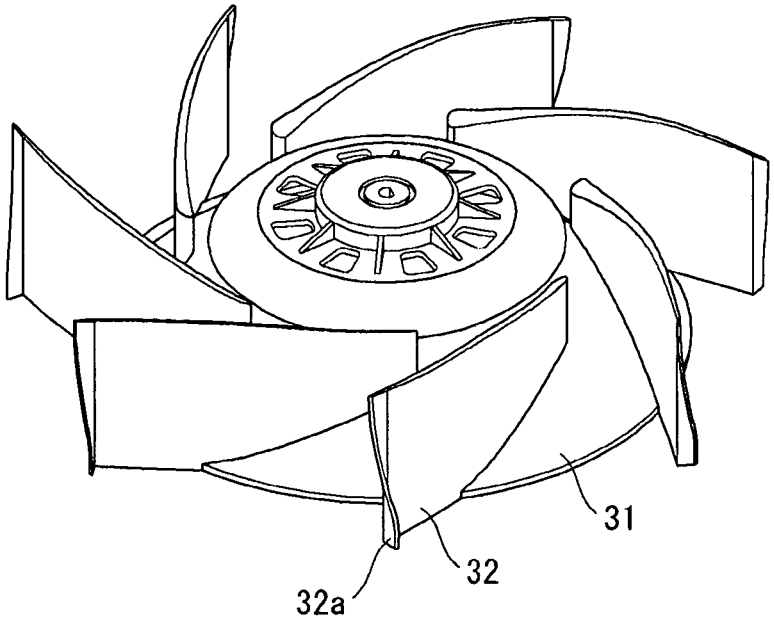
FIG. 6 is a perspective view of the centrifugal fan of FIG. 5, shown without a shroud.
Figure 7:
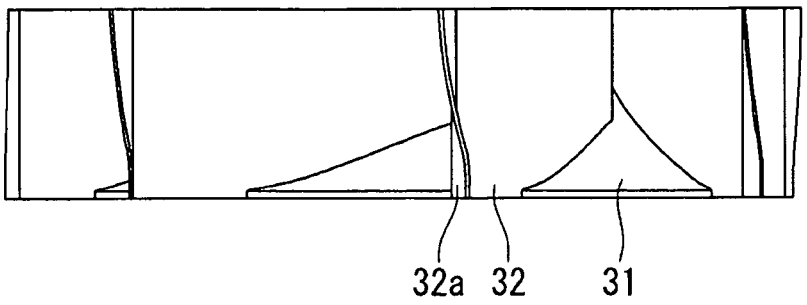
FIG. 7 is a side view of the centrifugal fan of FIG. 5.

FIG. 5 is a perspective view of a centrifugal fan according to an embodiment. FIG. 6 is a perspective view of the centrifugal fan of FIG. 5, shown without a shroud. FIG. 7 is a side view of the centrifugal fan of FIG. 5.

The centrifugal fan 30 according to the embodiment, as shown in FIG. 5, may include a hub 31 having a plurality of blades 32, and a shroud 33. A tip of each blade 32 may have a gurney flap similar to the one that is, for example, provided at a tail portion of a racing car to increase a down force.

Figure 8:
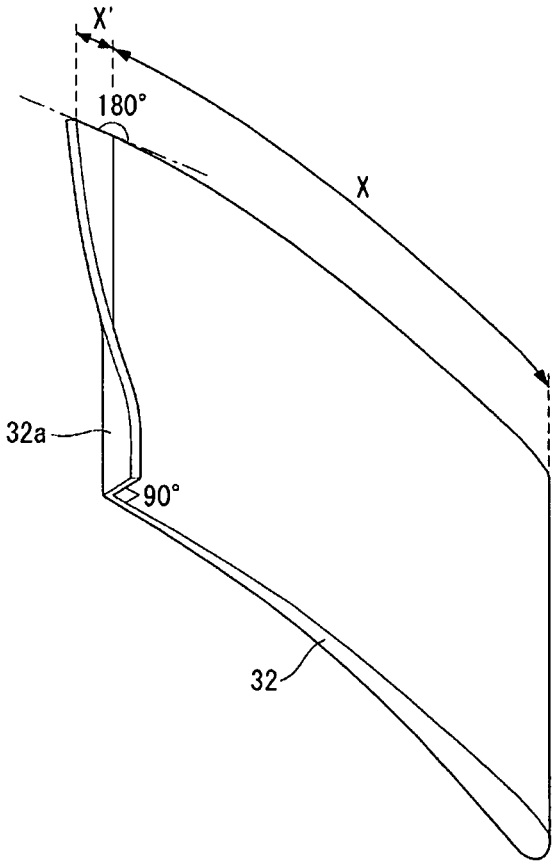
FIG. 8 is a schematic perspective view of a blade of the centrifugal fan of FIG. 5.

For example, as shown in FIG. 6, the tip of each blade 32 may have a gurney flap formed linearly to have a twisted 3D shape similar to an S shape. An upper side or end of the gurney flap 32*a* may be parallel to an upper side or end of the blade 32, that is, the upper side or end of the gurney flap 32*a* may be positioned horizontal at approximately 180 degrees with respect to the upper side or end of the blade 32, as shown in FIG. 8, and a lower side or end of the gurney flap 32*b* may be positioned perpendicular to, that is, at approximately 90 degrees with respect to, a lower side or end of the blade 32. Resultantly, the upper side and lower side of the gurney flap 32*b* may have a linear twisted shape similar to the letter S.

The blade 32 and the twisted gurney flap 32*a* may be integrally injection-molded, so that a horizontal length of the gurney flap 32*a* is shorter than a horizontal length of the blade 32. For example, as shown in FIG. 8, if a horizontal length X of the blade 32 is approximately 20 cm, the gurney flap 32*a* formed in or at the tip of the blade 32 may be injection-molded so that a horizontal length X' of the gurney flap 32*a* does not exceed approximately 4 mm. In other words, the horizontal length X' of the gurney flap 32*a* may not exceed approximately 2% of the horizontal length X of the blade 32.

The blade 32 having the twisted gurney flap 32*a* at its tip may be integrally injection-molded with the hub 32.

Figure 3:
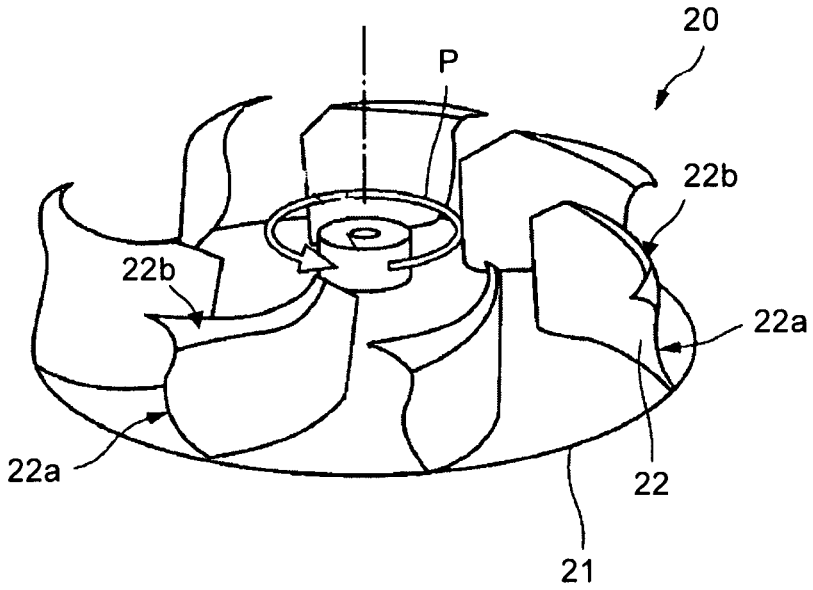
FIG. 3 illustrates a centrifugal fan according to the prior art.
Figure 4A:
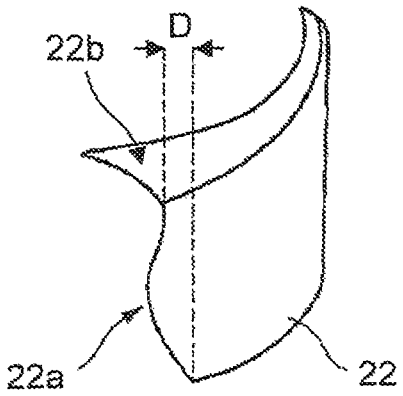
FIGS. 4A-4B illustrate an air flow and a wing tip vortex generated at blades of centrifugal fan of FIG. 3.
Figure 4B:
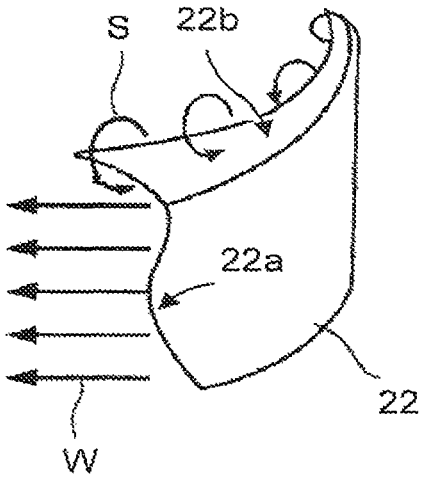

According to embodiments disclosed herein, a sophisticated blade 22 is not provided as described above in connection with FIG. 3, in which a side of the blade 22 has a twisted stereoscopic shape 22*a* while an upper side of the blade 22 has a gentle wing tip 22*b*. Instead, an S-shaped gurney flap 32*a* having a relatively simple structure may be added to a tip of the blade 32 as described above in connection with FIG. 6, so that the blade 32 may be integrally injection-molded with the gurney flap 32*a*. Further, the blade 32 having the gurney flap 32*a* may be easily injection-molded integrally with the hub 31, thus rendering it easy to injection-mold the centrifugal fan.

Figure 9:
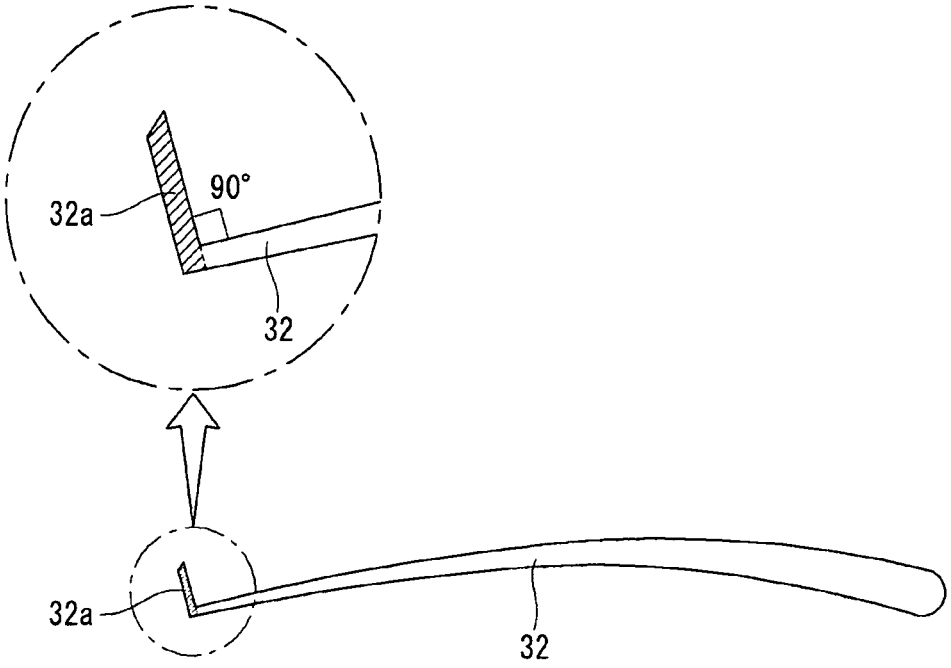
FIG. 9 is a cross-sectional view of a lower side of a blade of the centrifugal fan of FIG. 5.

FIG. 9 is a cross-sectional view of a lower side of a blade of the centrifugal fan of FIG. 5. As described above, a lower side of the gurney flap 32*a* integrally formed in or at the tip of the blade 32 may be formed perpendicular to, that is at approximately 90 degrees with respect to, the blade 32. Accordingly, a fluid that is being discharged to outside along a side surface of the blade 32 may collide with the lower side of the gurney flap 32*a*, which may be formed at approximately 90 degrees by injection molding, thereby changing its direction. Thus, the lower side of the gurney flap may function as a suction surface that suppresses wing tip vortex, thereby effectively decreasing noise.

Figure 10:
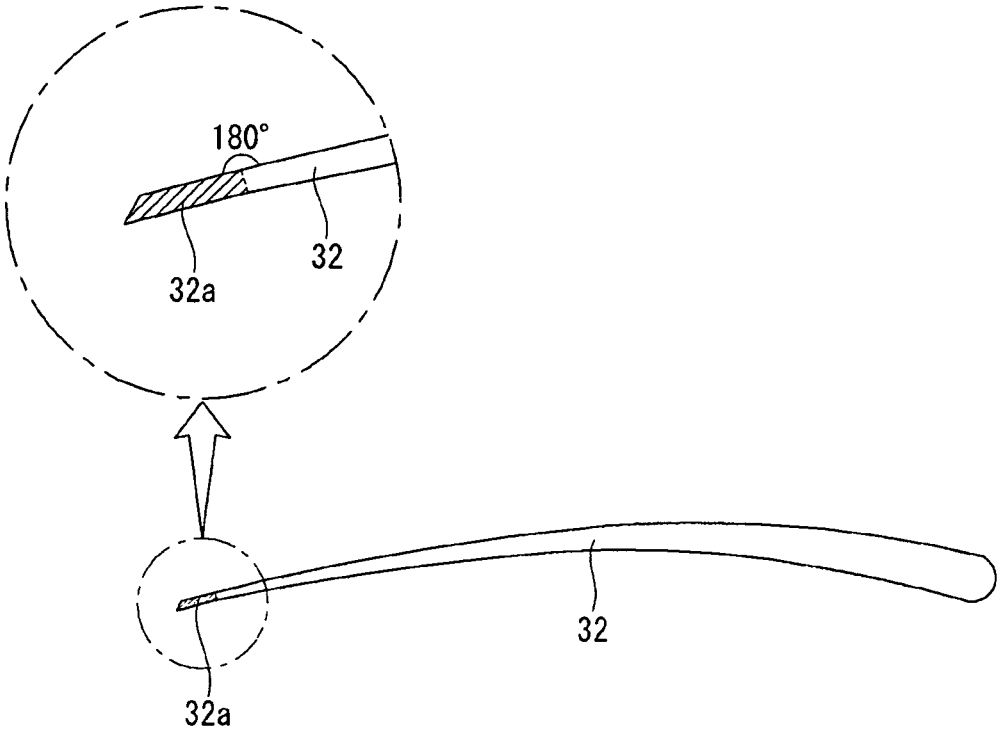
FIG. 10 is a cross-sectional view of an upper side of a blade of the centrifugal fan of FIG. 5.

FIG. 10 is a cross-sectional view of an upper side of a blade of the centrifugal fan of FIG. 5. As described above, an upper side of the gurney flap 32*a* integrally formed in a tip of the blade 32 by injection molding may be formed horizontal, that is, at approximately 180 degrees, with respect to the blade 32. Accordingly, a fluid that is being discharged along a side surface of the blade 32 may pass through the upper side of the gurney flap 32*a* formed horizontally at approximately 180 degrees, so that the upper side of the gurney flap may maintain a direction of the fluid discharged to the outside, thereby enhancing performance of blowing of air.

Therefore, according to embodiments disclosed herein, a S-shaped, twisted gurney flap having a relatively simple structure may be formed in or at a tip of a blade provided in a hub of a centrifugal fan, thus allowing for noise reduction, increasing fan efficiency, and making it easy to injection-mold.

Figure 11:
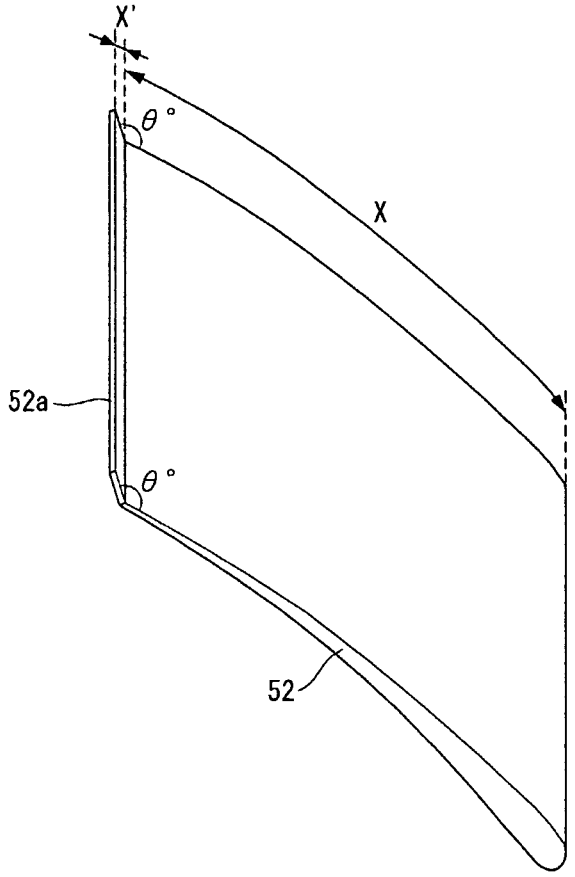
FIG. 11 illustrates a blade of a centrifugal fan according to another embodiment.

FIG. 11 illustrates a blade of a centrifugal fan according to another embodiment. In the instant embodiment, a gurney flap 52*a* having a rectangular plate may be formed in a tip of a blade 52 provided in a hub of the centrifugal fan.

Figure 12:
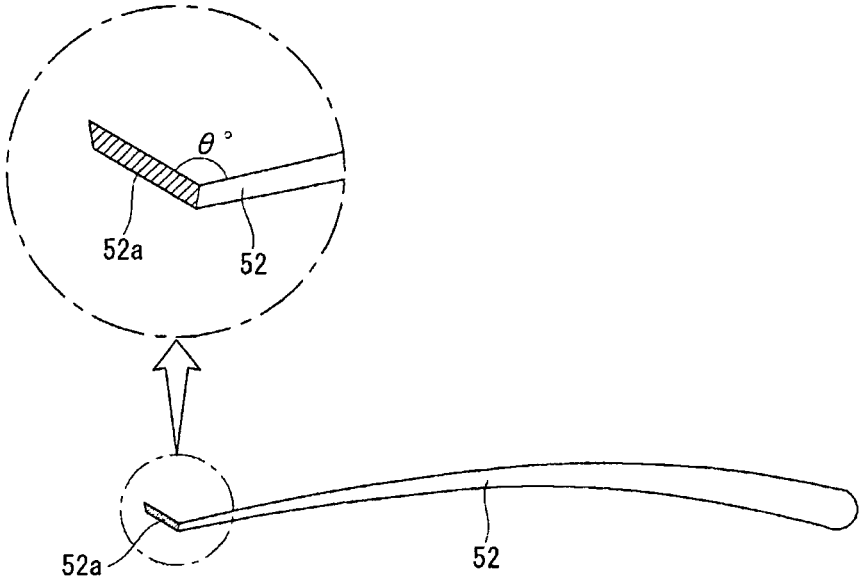
FIG. 12 is a side view of the blade of FIG. 11.

The gurney flap 52*a*, as shown in FIG. 12, may be integrally injection-molded with the blade 52, while making a predetermined angle θ with respect to the plane of a blade 52. The angle θ may be one of approximately 90 degrees, approximately 135 degrees, and approximately 150 degrees with respect to the plane of the blade 52. For example, considering noise reduction and increasing fan efficiency, the angle θ may be approximately 135 degrees.

Embodiments disclosed herein provide a centrifugal fan that may include a hub, the hub including a plurality of blades. A gurney flap may be formed in a tip of each of the plurality of blades. The gurney flap may have an S-shaped, twisted shape.

An upper side or end of the gurney flap may be horizontal, or formed at approximately 180 degrees, with respect to an upper side or end of each blade, and a lower side of the gurney flap may be perpendicular to, or formed at approximately 90 degrees with respect to, a lower side or end of each blade. Further, the gurney flap may be a rectangular plate and form a predetermined angle with respect to a plane of the blade. The predetermined angle may be any one of approximately 90 degrees, approximately 135 degrees, and approximately 150 degrees. A horizontal length of the gurney flap may not be more than approximately 2% of a horizontal length of the blade.

The hub may be integrally formed by injection molding with the plurality of blades each having the gurney flap. An upper side of the hub may have a shroud with a fluid inlet hole.

Accordingly, the centrifugal fan according to embodiments disclosed herein may efficiently reduce noise and increase efficiency. Further, a blade having a flap may be integrally injection-molded with a hub, thus enhancing productivity of the centrifugal fan.

Although embodiments have been described, it will be understood by those of ordinary skill in the art that various changes or modifications may be made thereto without departing from the scope as defined in the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A centrifugal fan, comprising:

a hub; and a plurality of blades provided on the hub, wherein a gurney flap is formed in or at a tip of each of the plurality of blades, wherein the gurney flap has a S-shaped, twisted shape, and wherein a horizontal length between both side ends of the gurney flap is not more than approximately 2% of a horizontal length between both side ends of the respective blade.

2. The centrifugal fan of claim 1, wherein an upper end of the gurney flap extends horizontally with respect to an upper end of the respective blade, and a lower end of the gurney flap extends perpendicular to a lower end of the respective blade.

3. The centrifugal fan of claim 1, wherein an upper end of the gurney flap is formed at approximately 180 degrees with respect to an upper end of the respective blade, and a lower end of the gurney flap is formed at approximately 90 degrees with respect to a lower end of the respective blade.

4. The centrifugal fan of claim 1, wherein the hub is integrally formed by injection molding with the plurality of blades each having the gurney flap.

5. The centrifugal fan of claim 1, wherein an upper side of the hub includes a shroud having a fluid inlet hole.

6. An air conditioner including the centrifugal fan of claim 1.

7. A centrifugal fan, comprising:

a hub; and a plurality of blades provided on the hub, wherein a gurney flap is formed in or at a tip of each of the plurality of blades, wherein the gurney flap has a S-shaped, twisted shape, and wherein the hub is integrally formed by injection molding with the plurality of blades each having the gurney flap.

8. The centrifugal fan of claim 7, wherein an upper end of the gurney flap extends horizontally with respect to an upper end of the respective blade, and a lower end of the gurney flap extends perpendicular to a lower end of the respective blade.

9. The centrifugal fan of claim 8, wherein a horizontal length between both ends of the gurney flap is not more than approximately 2% of a horizontal length between both ends of the respective blade.

10. The centrifugal fan of claim 7, wherein an upper end of the gurney flap is formed at approximately 180 degrees with respect to an upper end of the respective blade, and a lower end of the gurney flap is formed at approximately 90 degrees with respect to a lower end of the respective blade.

11. The centrifugal fan of claim 7, wherein an upper side of the hub includes a shroud having a fluid inlet hole.

12. An air conditioner including the centrifugal fan of claim 7.

* * * * *